United States Patent [19]

Thomas et al.

[11] 4,385,450

[45] May 31, 1983

[54] PROCESS AND APPARATUS FOR REDUCING THE AMOUNT OF LIQUID FROM A POROUS MATERIAL BY MEANS OF SUPERHEATED STEAM FROM SAID LIQUID

[75] Inventors: Jean Thomas, Verlinghem; Jacques Lanéres, Bondues; Jean P. Leonard, Marcq en Baroeul, all of France

[73] Assignee: Institut Textile de France, Boulogne, France

[21] Appl. No.: 190,949

[22] Filed: Sep. 26, 1980

[30] Foreign Application Priority Data

Oct. 1, 1979 [FR] France ..... 79 24440

[51] Int. Cl.[3] ..... F26B 3/06

[52] U.S. Cl. ..... 34/21; 34/37; 34/77; 34/104

[58] Field of Search ..... 34/21, 104, 77, 9, 36, 34/37, 105, 106, 34, 54, 94, 94 A

[56] References Cited

U.S. PATENT DOCUMENTS

| | | | |
|---|---|---|---|
| 2,871,574 | 2/1959 | Thies | 34/104 |
| 3,962,798 | 6/1976 | Jackson | 34/9 |
| 3,998,588 | 12/1976 | Coraor et al. | 165/1 |
| 4,075,765 | 2/1978 | Karrer et al. | 34/104 |
| 4,085,518 | 4/1978 | Jackson et al. | 34/104 |

*Primary Examiner*—Larry I. Schwartz

*Attorney, Agent, or Firm*—Posnack, Roberts, Cohen & Spiecens

[57] ABSTRACT

Process and apparatus for reducing the liquid content of a porous material by means of superheated vapor from said liquid. The apparatus comprises, in order: a vapor generator 1; a circulation fan 2; a vapor superheater 6; a closed, sealed chamber 7, and an assembley 22–26 to provide in the chamber 7 a passage for fluid and for supporting textile material 9 such that it is interposed in the path of the vapor; a vapor condenser 13; a valve for regulation of pressure 16; a conduit for recycling vapor 17, and a device **32, 32*a*** to measure the temperature prevailing in the fluid passage upstream of the porous material.

10 Claims, 2 Drawing Figures

PROCESS AND APPARATUS FOR REDUCING THE AMOUNT OF LIQUID FROM A POROUS MATERIAL BY MEANS OF SUPERHEATED STEAM FROM SAID LIQUID

FIELD OF THE INVENTION

The present invention concerns a process for reducing the liquid content of a porous material impregnated by this liquid, to a predetermined content, of the type according to which this material is placed and supported in a closed, sealed chamber constituting a path for passage of fluid provided in a body, such that this material is interposed in this path over the totality of the cross-section of the latter, and there is fed at one end, referred to as the inlet, of said fluid passage with superheated vapor of said liquid by establishing, in the fluid passage respectively upstream and downstream of the material to be treated, a pressure difference ($P_1-P_2$) in the direction decreasing from upstream to downstream, in order that the impregnation liquid is evaporated upon contact with this superheated vapor and is carried away in vapor state by the vapor flow.

PRIOR ART

Up to the present, the drying of porous material and, particularly textile material is often carried out by drying this material by a current of hot air. This known process requires relatively long periods of drying (typically from 10 to 20 hours for a dryer for preliminarily dried spools); since the quantity of moisture which can be transported by the air is limited, it is necessary to constantly renew this air, which leads to an excessive use of energy and a risk of degradation of the material by an excessive heating and/or by prolonged contact with the hot and moist air.

Nevertheless, there is known, notably from French Pat. No. 2.312.275, a process of the preceding type utilizing the passage of superheated vapor through the porous material to reduce the liquid content thereof.

The known process, while contributing to improving the elimination operation notably of organic volatile liquids not miscible with water, however, has not been able to be exactly perfected to control and minimize the amounts of energy consumed in the course of the process.

SUMMARY OF THE INVENTION

The invention overcomes these disadvantages and notably has for its object to provide a process permitting the regulation of the amount of energy effectively consumed to a value just necessary to achieve the desired liquid content for the material to be treated.

This object is attained, according to the invention, in that the vapor temperature ($T_2$) downstream of the material is measured and the feed of superheated vapor at the inlet of the fluid passage is halted when this temperature reaches a predetermined value corresponding to the said predetermined liquid content of the material.

Furthermore, since the chamber in which the material is treated is closed and sealed to the vapor that it contains, it is possible to provide therein a pressure less than atmospheric, for example, by condensing a portion of the vapor downstream of the chamber, it is thus possible to lower the temperature of the superheated vapor traversing the material; this advantage permits application of the present process to the drying of delicate materials not resistant to high temperatures.

Advantageously, the magnitude of the difference of pressure is a decreasing function of the flow of vapor traversing the said material.

Thus, in proportion to the reduction of the liquid content of the material, the loss of charge opposed by the material to the passage of the vapor diminishes and as a result, there is an increase of flow of the vapor through the material. The difference of pressure upstream and downstream of the material therefore diminishes; thus the amount of energy furnished to the material is adapted to the quantity precisely necessary to continue the drying of this material.

Advantageously, downstream of the material, the quantity of vapor equivalent to the vapor corresponding to the evaporated liquid of impregnation from the said material is condensed, and the condensate thus obtained is removed and the remaining vapor is reutilized to feed the inlet end of the fluid passage.

Advantageously, prior to the drying of the material by evaporation of the liquid of impregnation, a first quantity of liquid is eliminated from this material by dehydration by feeding a compressed gas to the inlet end of the fluid passage.

Advantageously, the said compressed gas is vapor of the impregnation liquid.

Advantageously, a constant pressure is maintained downstream of the material to be treated.

Advantageously, the material to be treated is a fibrous material such as textile material.

Advantageously, the liquid of impregnation comprises water.

This process is put into operation advantageously in an apparatus of the type which comprises the following: a vapor generator; a circulation fan whose suction inlet is connected to the outlet of the vapor generator; a vapor superheater; a closed, sealed chamber having an inlet connected to the superheater, an outlet, and means to provide in the chamber a fluid passage between the said inlet and the said outlet and to hold the porous material in the chamber such that this material is interposed in the path of the vapor in the said passage over the totality of a cross-section of the latter; a vapor condenser connected to the outlet of the chamber and a conduit for recycle of vapor connecting the outlet of the chamber to the inlet of the fan; and characterized, in addition, according to the invention, by a device for measuring the temperature prevailing in the said fluid passage downstream of the porous material, in the direction of travel of the vapor, and by a valve for control of pressure interposed between the condenser and the outlet of the chamber to maintain constant the pressure at the said outlet of the chamber.

BRIEF DESCRIPTION OF THE DRAWINGS

Further characteristics and advantages of the invention will become understood from a reading of the description which follows of an embodiment and with reference to the attached drawings in which.

DETAILED DESCRIPTION

Figure 1:
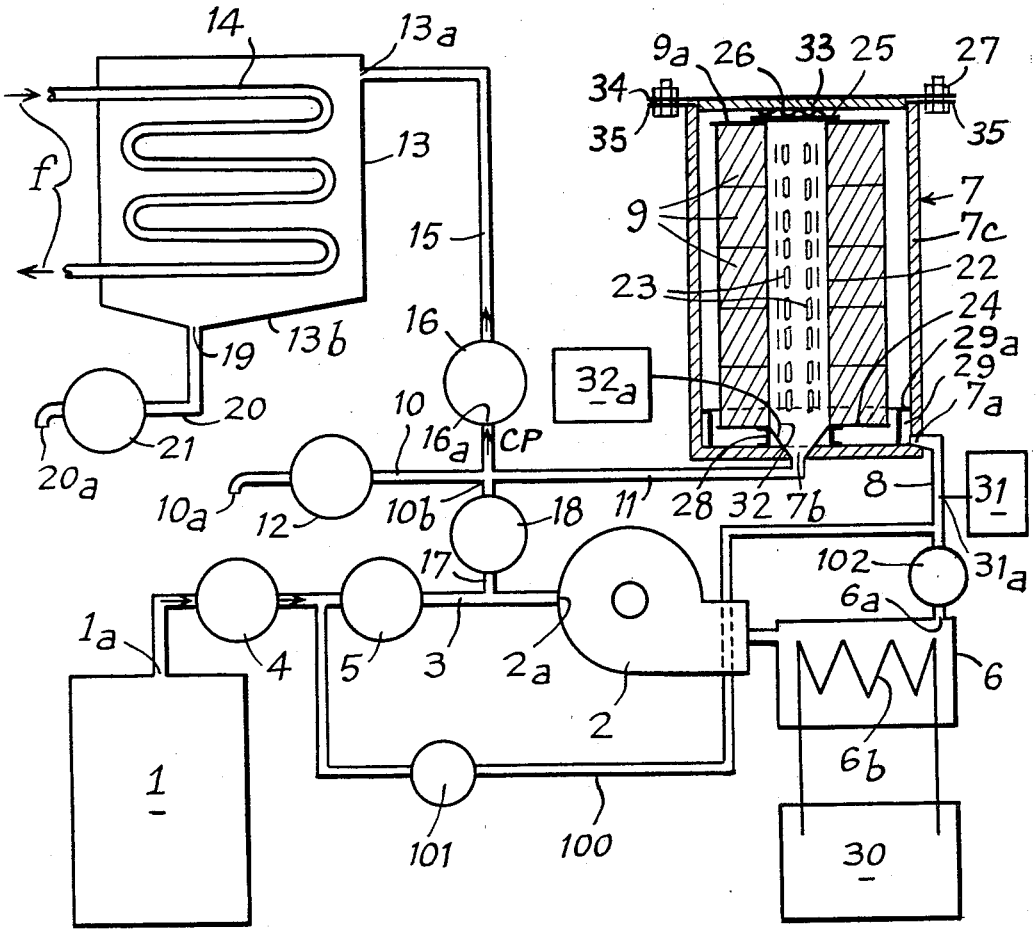
FIG. 1 is a diagram of apparatus for dehydrating and drying spools of textile product according to one embodiment of the invention.

The apparatus shown in FIG. 1 comprises:

a steam generator (boiler 1);

a centrifugal fan or pump 2 whose suction inlet 2*a* is connected to the steam outlet 1*a* of the boiler 1, through the intermediary of a conduit 3 in which are interposed, in order in the direction from the boiler to the fan 2, an expander or pressure reduction valve 4 and a closure gate or valve 5;

a heater, for example, electric heater 6 heating the vapor fed by the fan 2;

a closed, sealed chamber 7 having a steam inlet 7*a* connected to the outlet 6*a* of the heater 6 by a conduit 8, and a steam outlet 7*b*, this chamber 7 receiving toroidal spools of filament, cable or textile ribbon 9 to be dried;

a discharge conduit 10 for water from dehydration 10 having one end 10*a* open to the atmosphere and its other end 10*b* connected to the steam outlet 7*b* of the chamber 7 through a connection conduit 11; a closure gate or valve 12 is interposed in the conduit 10;

a condenser 13 having a closed chamber in which is disposed a cooling coil 14 through which flows a cooling fluid (arrows f); the inlet 13*a* of the condenser is connected to the steam outlet 7*b* of the chamber 7, through the intermediary of a conduit 15 and the connection conduit 11; a regulating valve 16 is interposed in the conduit 15; this valve 16 is of the type effecting a constant pressure at its upstream inlet 16*a* through a suitable regulation of the section of the passage that it offers to the fluid which traverses it; and a conduit 17 for recycle of steam connecting, through the intermediary of the connection conduit 11, the steam outlet 7*b* of the chamber 7 to the suction inlet 2*a* of the fan 2; this conduit 17 opening into the conduit 3 between the closure valve 5 and the said suction inlet 2*a*; a closure gate or valve 18 is interposed in this conduit 17.

The assembly of members which have just been described is carefully heat-insulated, that is to say, isolated thermally from the exterior environment.

The condenser 13 has a base 13*b* whose walls are inclined downwardly towards a condensation outlet 19 provided in the said base 13*b*; a conduit 20 for discharge of condensate is connected to the outlet 19; this conduit is open to the atmosphere at its end 20*a* opposite the outlet 19; a closure gate or valve 21 is interposed in the conduit 20.

The spools 9 are mounted with friction on a support comprising a vertical cylindrical tube 22 having a wall provided with holes 23, and a solid, planar, annular, horizontal wall, serving as an abutment 24, secured to the tube 22 and projecting radially outwards from the lower end of the latter.

The spools 9 are placed on the tube 22 until the lower spool abuts against the wall 24; the spools are thus mounted in mutually adjoining relation on the support 22, 23, 24. At the upper end of this support 22, 23, 24, a circular locking member serving as a cover 25 forms, on the one hand, a sealed cover closing the upper end of the tube 22 and, on the other hand, a locking plate axially pressing the spools 9 downwardly against the abutment wall 24. In this regard, a compression spring 26 is interposed between the upper wall 33 of the chamber 7 and the cover 25 to apply this cover 25 in sealed fashion against the upper end surface 9*a* of the upper spool 9. The upper wall 33 is fixed in adjustable fashion from the remainder of the chamber 7 by means of peripheral flanges 34,35 on which are mounted locking bolts 27. The abutment wall 24, as well as the cover 25 extend radially outwards in a manner to cover the totality of the adjacent end face of the corresponding spool 9. The support 22,23,24 is fixed in the chamber 7 by suitable means such as screws or welds through the intermediary of an annular connection member 28 of U-shaped section coaxial to and of the same diameter as the tube 22. The outlet 7*b* opens into the open lower extremity of the tube 22.

The inlet 7*a* opens into a closed, annular space 29 which is provided in the chamber 7 at the lower end of the lateral wall 7*c* of the chamber 7, and whose upper end 29*a* is open and opens into the interior volume of the chamber 7.

There will now be described hereafter an example according to the invention of how the apparatus shown in FIG. 1 is put into operation, in the particular case where the spools 9 are filament, or cable, or ribbon of cotton containing water of the order of 300% by weight of water.

During a first phase, referred to as dehydration, the spools 9 are dried by circulating in the chamber 7 steam under pressure furnished from the boiler 1, for example, through the intermediary of a by-pass conduit 100 short-circuiting the valve 5, the fan 2 and the heater 6. A closure valve 101 is interposed in the conduit 100 and another closure valve 102 is interposed in the conduit 8 between the heater 6 and the junction of the conduits 100 and 8.

In the course of drying, the valves 5, 12 and 101 are open, whereas the valves 16 and 18 and 102 are closed. The water content of the spools is reduced thereby to 100% by weight.

During a second phase, referred to as drying, the valves 5 and 12 are closed, the valve 16 is actuated and the valve 18 is opened. The superheated steam coming from the heater 6 is fed into the chamber 7 wherefrom it flows through the outlet 7*b* after having traversed the textile material of the spools 9. The steam is then reintroduced by the conduit 17 to the suction inlet 2*a* of the fan 2, the valve 16 maintaining a constant pressure in the conduits 11, 17 and 3. In this regard, steam is evacuated via the valve 16 to be condensed in the condenser 13. The fan 2 applies a pressure gradient in the steam circulation circuit thus formed. This fan 2 also contributes to heating the steam that it receives at its inlet 2*a*. However, the heater 6 furnishes the heat necessary in order for the temperature of the steam admitted into the chamber to be sufficient to effect a suitable drying of the spools 9 in a determined time. The heater 6 comprises an electrical heating resistor 6*b* fed by current from an adjustable voltage source 30. The temperature of the steam upstream and downstream of the textile material 9 is measured by means of respective probes 31 and 32, each provided with a suitable measurement device 31*a*, 32*a*. The probe 31 is disposed in the conduit 8; the probe 32 is placed in the chamber 7 at the outlet of tube 22.

Figure 2:
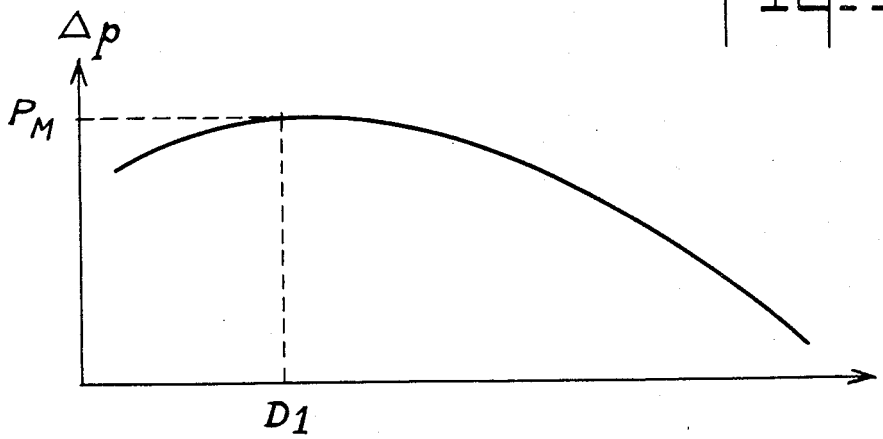
FIG. 2 is a graph representing the relation of pressure/flow of the fan utilized in the apparatus of FIG. 1.

In FIG. 2, there is represented the relation of pressure/flow of the fan 2 of centrifugal type. As shown in FIG. 2, the fan 2 has been constructed to furnish a substantially maximum pressure $P_M$ when the steam flow passing through the textile material 9 is minimal and equal to $D_1$, this flow corresponding to the load in pounds of water of the textile material 9 going from 300% to 100%.

In the course of the drying phase, this discharge of steam is increased so that the pressure of the steam $P_1$ leaving the heater 6 is diminished.

The spools 9 are dried from an initial content by weight of water of 100% to a final content of about 8.25% under the following conditions:

$P_1$ = the pressure of the steam entering the chamber 7;

$T_1$ = the temperature of the steam entering the chamber 7 (temperature measured by the probe 31);

$P_2$ = the pressure of the steam leaving the chamber 7;

$T_2$ = the temperature of the steam downstream of the textile material (temperature measured by the probe 32);

$P_2$ is maintained in the region of 1 bar by means of the valve 16.

From the beginning of the drying phase, a pressure difference of $P_1 - P_2$ of the order of 200 to 300 millibars and a superheated steam temperature of $T_1$ of the order of 120° to 130° C. is established by a suitable choice of the fan 2 and its speed of rotation, and by means of an appropriate adjustment of the voltage source 30, the fan 2 being selected to have a nominal power less than that which would be necessary to obtain steam at these pressures $P_2$ between 1.2 and 1.3 bars and at these temperatures $T_2$;

The drying stage is halted when $T_2$ equals 107° C.

It has been experimentally found that this particular value of $T_2$ corresponds to the final moisture content h of 8.24% that can be obtained for the spools 9.

In general fashion, for a given value of $P_2$, for each value of h there is a corresponding, well-determined value for $T_2$. The process described hereabove thus permits halting the drying of the textile material and therefore of halting the supply of energy to this material precisely at the instant when the latter has the required moisture content h.

It is noted that by maintaining $P_2$ at a constant value by means of the regulation valve 16, one permits the condensation in the condenser 13 of exactly the quantity of steam equivalent to the steam corresponding to the water of the spools 9 evaporated in the chamber 7.

The invention is not limited to the drying of fibrous materials impregnated with water, but it extends, in contrast, to the drying of fibrous materials or more generally porous materials impregnated with a liquid containing water or not containing water such as an inorganic solvent (chlorinated solvent such as perchloroethylene, alcohol, etc.).

We claim:

1. Process for reducing the liquid content of a porous material 9 impregnated with this liquid to a predetermined liquid content (h) which is greater than zero, said process comprising placing this material in a closed, sealed chamber 7 constituting a path for travel of fluid in a body, such that this material is interposed in said path of travel over the totality of a transverse section of the latter, feeding an inlet of said fluid path with superheated vapor of the said liquid while establishing in the fluid path respectively upstream and downstream of the material to be treated a difference of pressure ($P_1 - P_2$) in the direction going from upstream to downstream, in order that the impregnation liquid is evaporated upon contact with said superheated vapor and is carried in the vapor state by the vapor flow, measuring the vapor temperature ($T_2$) downstream of the material 9 and halting the feed of superheated vapor to the inlet of the fluid path when said temperature reaches a predetermined value corresponding to the said predetermined liquid content of the material.

2. Process according to claim 1, comprising establishing a pressure less than atmospheric pressure in said chamber by condensing a portion of the vapor downstream of the said chamber.

3. Process according to claim 1 wherein the amplitude of the said difference of pressure ($P_1 - P_2$) is a decreasing function of the flow of vapor transversing the said material.

4. Process according to claim 1 wherein downstream of the material there is condensed a quantity of vapor equivalent to the corresponding evaporated impregnation liquid coming from the said material, the condensate thus obtained being eliminated and the vapor remaining being reutilized to feed the inlet end of the fluid passage.

5. Process according to claim 1 wherein prior to the drying of the material by evaporation of the impregnation liquid, a first quantity of liquid is removed from this material by dehydration by feeding the inlet end of the fluid passage with a compressed gas.

6. Process according to claim 5 wherein the said compressed gas is vapor of the impregnation liquid.

7. Process according to claim 1 wherein a constant value of pressure $P_2$ downstream of the material to be treated.

8. Process according to claim 1 wherein the material to be treated 9 is a fibrous material such as a textile material.

9. Process according to claim 1 wherein the impregnation liquid comprises water.

10. Apparatus for diminishing the liquid content of a porous material 9 impregnated with this liquid to a predetermined liquid content (h) which is greater than zero comprising the following: a vapor generator 1, a vapor superheater 6, a closed, sealed chamber 7 having an inlet **7*a* connected to the superheater 6, an outlet 7*b*, and means 22 to 26,28,29 to provide in the chamber 7 a fluid passage between the said inlet 7*a* and the said outlet 7*b* and to hold the porous material 9 in the chamber 7 such that this material is interposed in the path of the vapor in the said passage over the totality of a transverse section of the latter, a vapor condenser 13 connected to the outlet 7*b* of the chamber, a fan 2 to establish a difference of pressure in the said fluid passage on both sides of the porous material 9, a recycle conduit 17 for vapor connecting the outlet 7*b* of the chamber to the inlet of the fan 2, means 32, 32*a* for measuring the temperature in the said fluid passage downstream of the porous material 9 in the direction of travel of the vapor, said temperature being indicative of the liquid content of the porous material and enabling halting of the drying of the material when the temperature indicates that the material is at the desired predetermined liquid content (h), and pressure regulation valve means 16 interposed between the condenser 13 and the outlet 7*b*** of the chamber for maintaining the pressure at the said outlet of the chamber constant.

* * * * *